US006877932B2

(12) United States Patent
Prévost

(10) Patent No.: US 6,877,932 B2
(45) Date of Patent: Apr. 12, 2005

(54) DRAINAGE SYSTEM AND METHOD FOR ARTIFICIAL GRASS USING SPACING GRID

(75) Inventor: Jean Prévost, Westmount (CA)

(73) Assignee: Fieldturf (IP) Inc., Montreal (CA)

( * ) Notice: Subject to any disclaimer, the term of this patent is extended or adjusted under 35 U.S.C. 154(b) by 0 days.

(21) Appl. No.: 10/193,153

(22) Filed: Jul. 12, 2002

(65) Prior Publication Data

US 2003/0039511 A1 Feb. 27, 2003

Related U.S. Application Data

(60) Provisional application No. 60/304,794, filed on Jul. 13, 2001.

(51) Int. Cl.[7] ..... E02B 11/00; D03D 27/00

(52) U.S. Cl. ..... 405/38; 405/36; 405/43; 405/302.7; 428/17

(58) Field of Search ..... 405/36, 38, 43, 405/46, 258.1, 302.7; 428/17, 212; 442/366, 367, 391, 392; 273/DIG. 3

(56) References Cited

U.S. PATENT DOCUMENTS

| | | | | | |
|---|---|---|---|---|---|
| 3,332,828 | A | * | 7/1967 | Faria et al | 428/17 |
| 3,740,303 | A | * | 6/1973 | Anderson et al. | 428/17 |
| 3,995,079 | A | * | 11/1976 | Haas, Jr. | 428/17 |
| 4,044,179 | A | * | 8/1977 | Haas, Jr. | 428/17 |
| 4,389,435 | A | * | 6/1983 | Haas, Jr. | 428/17 |
| 4,396,653 | A | * | 8/1983 | Tomarin | 428/17 |
| 4,421,439 | A | * | 12/1983 | ter Burg et al. | 405/302.7 |
| 4,472,086 | A | * | 9/1984 | Leach | 405/302.7 |
| 4,735,825 | A | * | 4/1988 | Friedrich | 428/17 |
| 4,815,892 | A | * | 3/1989 | Martin | 405/45 |
| 5,255,998 | A | | 10/1993 | Beretta | |
| 5,460,867 | A | * | 10/1995 | Magnuson et al. | 428/178 |
| 5,601,886 | A | * | 2/1997 | Ishikawa et al. | 428/17 |
| 5,958,527 | A | | 9/1999 | Prevost | |
| 5,976,645 | A | | 11/1999 | Daluise et al. | |
| 6,171,984 | B1 | * | 1/2001 | Paulson et al. | 405/36 |
| 6,221,445 | B1 | * | 4/2001 | Jones | 428/17 |
| 6,299,959 | B1 | * | 10/2001 | Squires et al. | 428/17 |
| 6,527,889 | B1 | * | 3/2003 | Paschal et al. | 428/15 |

FOREIGN PATENT DOCUMENTS

| | | | | |
|---|---|---|---|---|
| CA | 2 218 314 | | 7/2002 | |
| CH | 670572 | * | 6/1989 | 428/425.5 |
| DE | 19521944 | * | 12/1995 | |
| EP | 185645 | * | 6/1986 | |

* cited by examiner

*Primary Examiner*—Jong-Suk Lee
(74) *Attorney, Agent, or Firm*—Factor & Lake, Ltd.

(57) ABSTRACT

A drainage system is provided for a synthetic grass turf assembly having a flexible and water permeable sheet backing for installation on a supporting soil substrate to provide a game playing surface. The draining system of the present invention prevents water from accumulating on the turf surface, which could cause the top-dressing layer to "float" and be moved by inundation. The draining system of the present invention includes a spacing grid disposed between the backing of the turf. The spacing grid is structured to permit water not only to be drained vertically through the spacing grid, but also to be drained horizontally through the spacing grid to the edges of the field. The spacing grid is made from one or more types of geotextile or plastics material with an adequate flexibility to improve the impact absorption capabilities and resilience of the synthetic grass turf assembly.

17 Claims, 7 Drawing Sheets

DRAINAGE SYSTEM AND METHOD FOR ARTIFICIAL GRASS USING SPACING GRID

This application claims priority on provisional Application No. 60/304,794 filed on Jul. 13, 2001, the entire contents of which are hereby incorporated by reference.

FIELD OF THE INVENTION

The invention relates to a synthetic grass turf to provide a game playing surface, and more particularly relates to a drainage system for a synthetic grass turf assembly for installation on a supporting substrate to provide a game playing surface.

BACKGROUND OF THE INVENTION

Synthetic grass sport surfaces are well known. They are used to replace natural grass surfaces which do not stand up well to wear and which require a great deal of maintenance. Also, natural grass surfaces do not grow well in partly or fully enclosed sport stadiums. The synthetic grass surfaces stand up to wear much better than the natural grass surfaces, do not require as much maintenance, and can be used in closed stadiums. Some synthetic grass surfaces comprise rows of strips or ribbons of a synthetic material, extending vertically from a backing mat with particulate material in-filled in between the ribbons on the mat. The ribbons of synthetic material usually extend a short distance above the layer of particulate material and represent blades of grass.

In order to reduce the abrasive nature of the synthetic grass infills and stabilize the top surface of the infills to retain a resilient grass-like surface that does not deteriorate in quality, or compact over time through use, a unique infilled layer of multiple distinct courses of a particulate material, for example, is disclosed in U.S. Pat. No. 5,958,527 which issued to Prevost on Sep. 28, 1999 and was assigned to the Assignee of this application. In Assignee's Canadian patent application No. 2,218,314, filed Oct. 16, 1997 and published on Sep. 10, 1998, the Assignee discloses a synthetic grass turf assembly.

When the synthetic grass turf assembly is installed on a sport field, however, an efficient drainage system under the grass turf assembly is needed because the water permeable backing cannot function well without a drainage system underneath to prevent water from accumulating on the turf surface. With certain infill materials, slow water evacuation could cause the infill material to float off of the surface, thereby creating an additional maintenance cost issue.

For example, U.S. Pat. No. 5,976,645, issued to Daluise et al on Nov. 2, 1999, discloses a vertical drainage system for a rubber-filled synthetic turf. The drainage system disclosed in this patent is deployed below a fabric backing layer of a synthetic turf and incorporates a porous geotextile membrane between an open graded aggregate layer and a sand layer above the aggregate layer to prevent the movement of one aggregate layer into the other. The drainage passages are generally formed with the 2-inch thick porous layer of sand and the 6-inch thick layer of sand and stone mixture. The draining rate depends on the particulate sizes and compact conditions of those layers. The porous geotextile membrane is used only for separating those two different layers.

A multiple-layer net structure for fluid drainage, particularly for geotechnical use, is well known in the art. A triplanar net, described in U.S. Pat. No. 5,255,998, which issued to Beretta on Oct. 26, 1993, for example, includes a first layer of mutually parallel wires which is rigidly associated with a second or intermediate layer of substantially mutually parallel wires, which are inclined with respect to the wires of the first layer. A third layer of wires is rigidly associated with the intermediate layer, on the opposite side thereof with respect to the first layer, and has substantially mutually parallel wires which are inclined with respect to the wires of the second or intermediate layer. In general and geotechnical use, such multiple-layer nets are buried and inclined with respect to the horizontal plane, so as to allow the drainage of any liquids to be eliminated from the region in which the drainage nets are located.

However, those multiple layer nets have not been suggested to be used in a drainage system for a synthetic grass turf assembly. Unlike other environments in which the multiple layer nets are used for drainage, a synthetic grass turf assembly for providing a game playing surface is a dynamic system continuously in movement under the influence of bouncing balls, vibration, and impacts from the feet and bodies of players in contact with the top surface of the turf. The more rigid grids do not alleviate the resilience of the synthetic turf. Many efforts have so far been made for improving such dynamic properties of synthetic grass turf assemblies.

Another problem with regard to the use of multiple layer nets in synthetic grass turf assembly is deformation resulting from radiant heat from the sun. A deformed multiple layer net not only statically affects the formation of a planar game playing surface but also jeopardizes the dynamic property thereof. For instance, the synthetic grass surface weight with an infill will not always correct the deformations caused by the curling of the edges of the net caused by absorbing heat from the sun. The net itself can form undulations by heat absorption both prior to and after the installation of the artificial grass system.

Therefore, there exists a need for a more efficient drainage system for a synthetic grass turf assembly, which meets the dynamic requirements for a game playing surface.

SUMMARY OF THE INVENTION

It is one object of the invention to provide a drainage system for a synthetic grass turf assembly for installation on a supporting substrate to provide a game playing surface.

It is another object of the invention to provide an improved drainage system for a synthetic grass turf assembly using a spacing device to provide additional draining capacity to the system to facilitate drainage.

It is a further object of the invention to provide a synthetic grass turf assembly for installation on a supporting substrate to provide a game playing surface, which includes an efficient drainage system to prevent water from accumulating on the turf surface.

It is also contemplated to use the drainage system embodying drainage tiles. Such drainage tiles are in the form of one-foot square, or more, interlocking tiles of molded plastic with vertical through openings.

A drainage system for a synthetic grass turf assembly having a flexible and water permeable sheet backing for installation on a supporting substrate to provide a game playing surface generally comprises a flexible, three-dimensional spacing device positioned between the backing and the supporting substrate, supporting the undersurface of the backing and having the backing spaced apart from the supporting substrate to form draining passages in both vertical and substantially horizontal directions.

The spacing device may be an assembly of interconnecting tiles preferably selected from plastics materials, having a plurality of elongated channels preferably parallel to each other, on at least one surface of the tile as well as through openings extending from one surface of the tile to the other, in a manner such that water is enabled to flow through the tile in a direction perpendicular to a major plane defined by the tile, and also in another direction from one edge of the tile to another edge such that the water to be drained can flow throughout the interconnected tile assembly. It is desirable to have the supporting substrate sloped to facilitate drainage.

The spacing device may alternatively be a grid preferably selected from geotextile materials, having a plurality of elongated grid members preferably parallel to each other, bonded with link elements in a manner such that water is enabled to flow through the grid in a direction perpendicular to a major plane defined by the grid, and also in another direction from one edge of the grid to an opposite edge. It is desirable to have the supporting substrate sloped downwardly from a field centerline to two opposed edges to facilitate drainage.

In one embodiment, it is desirable that the support substrate has a non-porous and stable crushed stone base directly under the spacing grid or tiles. This stone is readily available and is lower in cost than specially graded stone. This method would reduce the cost of the substrate construction by allowing the water to drain horizontally to the edges, thus reducing the need for a more complicated and costlier drainage system under the support substrate. This in effect simulates the characteristics of having a nonporous asphalt or concrete base. A geotextile fabric or impermeable liner could be placed directly on the stone base to prevent the water from percolating through the stone base.

The latter drainage device is a grid type of plastics material which preferably comprises a plurality of longitudinal grid members in a base layer to form the substantially horizontal drainage passages therebetween when the grid is positioned between the backing and the supporting substrate. A plurality of link elements in two outer layers associated with two opposite sides of the base layer bond the grid members in position to form the grid without blocking either the vertical draining passages or the substantially horizontal draining passages. The spacing grid is preferably made of an extruded triplanar plastic structure having adequate properties in regard to flexibility, firmness, and resilience. White colour is preferred to reduce heat absorption and, therefore, to prevent or minimize deformation of the spacing grid from the heat of the sun.

It may also be desirable to place a porous aggregate layer, preferably formed with selectively sized crushed rocks, between the supporting substrate and the spacing device so that water is enabled to be drained through the spacing device into the porous aggregate layer.

An additional advantage of using the spacing device relates to the property of the adequate combination of resilience and firmness of the material. The resilience yet firmness of the spacing grid will further improve the impact absorption capability of the synthetic grass turf assembly which is an important property of a game playing surface especially in shorter pile infilled synthetic grasses.

Other features and advantages will be better understood with reference to a preferred embodiment described below.

BRIEF DESCRIPTION OF THE DRAWINGS

Having thus generally described the nature of the invention, reference is now given to drawings by way of examples only illustrating a preferred embodiment in which.

DETAILED DESCRIPTION OF THE PREFERRED EMBODIMENT

Figure 1A:
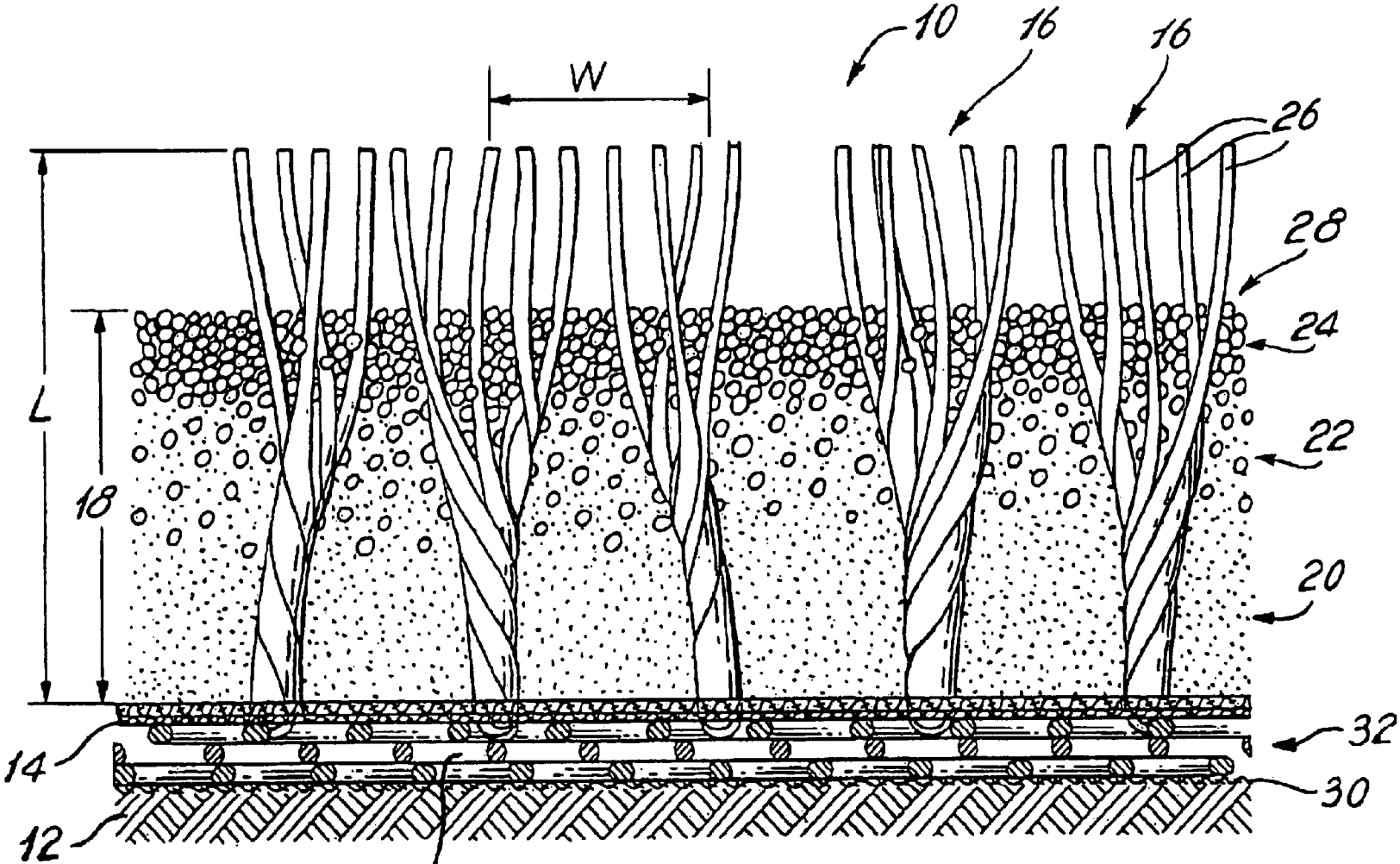
FIG. 1*a* is a cross-sectional view of an installed synthetic grass turf assembly with a drainage system according to a preferred embodiment of the invention.

With reference to FIG. 1, a synthetic grass turf assembly, generally indicated at numeral 10, is installed on a supporting soil substrate to provide a game playing surface. The synthetic grass turf assembly 10 has a pile fabric including a flexible sheet backing 14 that in the embodiment shown is a two-ply open weave fabric. Extending upwardly from an upper surface of the backing 14 is a large number of upstanding synthetic ribbons 16. As indicated in FIG. 1, the ribbons 16 are tufted through the backing 14 spaced apart in rows by a distance W and of a length L. The length is selected depending upon the depth of an infill 18 and the desired resilience of the completed synthetic grass turf assembly.

The ribbons 16 may include a mixture of multiple fibers and the single ribbons fibrillated when manufactured, or fibrillated on site or left in their original state. The on-site fibrillation can be done by passing over the turf surface with a wire brush, for example, or other brushing means after installation of the infill 18. Generally, thin fibers cannot be easily top-dressed on site since they are more fragile and fall more easily than thicker fibers, especially in high heat environments. The mix of thick and thin fibers on the ribbons can cause a ball to roll in a more predictable manner depending on the resistance of the fibers to the moving ball. Modification of the ribbon width and density in the turf will also modify the ball-rolling characteristics.

The ribbons 16 are made from suitable synthetic plastic material which is extruded in a strip that is relatively wide and thin. The details of the synthetic ribbons 16 and the porous sheet backing 14 as well as the method for attaching the ribbons 16 to the sheet backing 14 are described in Canadian Patent Application 2,218,314 which is incorporated herein by reference.

Deposited interstitially between the upstanding ribbons 16 upon the upper surface of the backing 14 is the infill layer 18 of particulate matter. The particulate matter may be selected from any number of commonly available hard granules, such as sand, small rocks or other graded particulate matter, and resilient granular, such as crumb rubber.

The infill layer 18 is made up of a base course 20, a middle course 22, and a top course 24. The base course 20 is substantially exclusively of hard sand granules disposed immediately upon the top surface of the backing 14. The middle course 22 is of intermixed hard sand granules and resilient rubber granules. The mix is selected on the basis of a weight ratio greater than 2 to 1 of hard and resilient granules respectively. The top course 24 is substantially exclusively of resilient rubber granules. It is noted that the infill can be all rubber.

An upper portion 26 of the synthetic ribbons 16 extends upwardly from a top surface 28 of the top course 24. The resulting artificial turf surface can be adapted for several indoor and outdoor uses, such as athletic playing fields, horse racing, and recreational areas. The detailed characteristics of the infill layer 18 and the selection, in particular, of the particulate sizes and unit weights of the respective courses are described in U.S. Pat. No. 5,958,527 which is incorporated herein by reference.

Figure 1B:
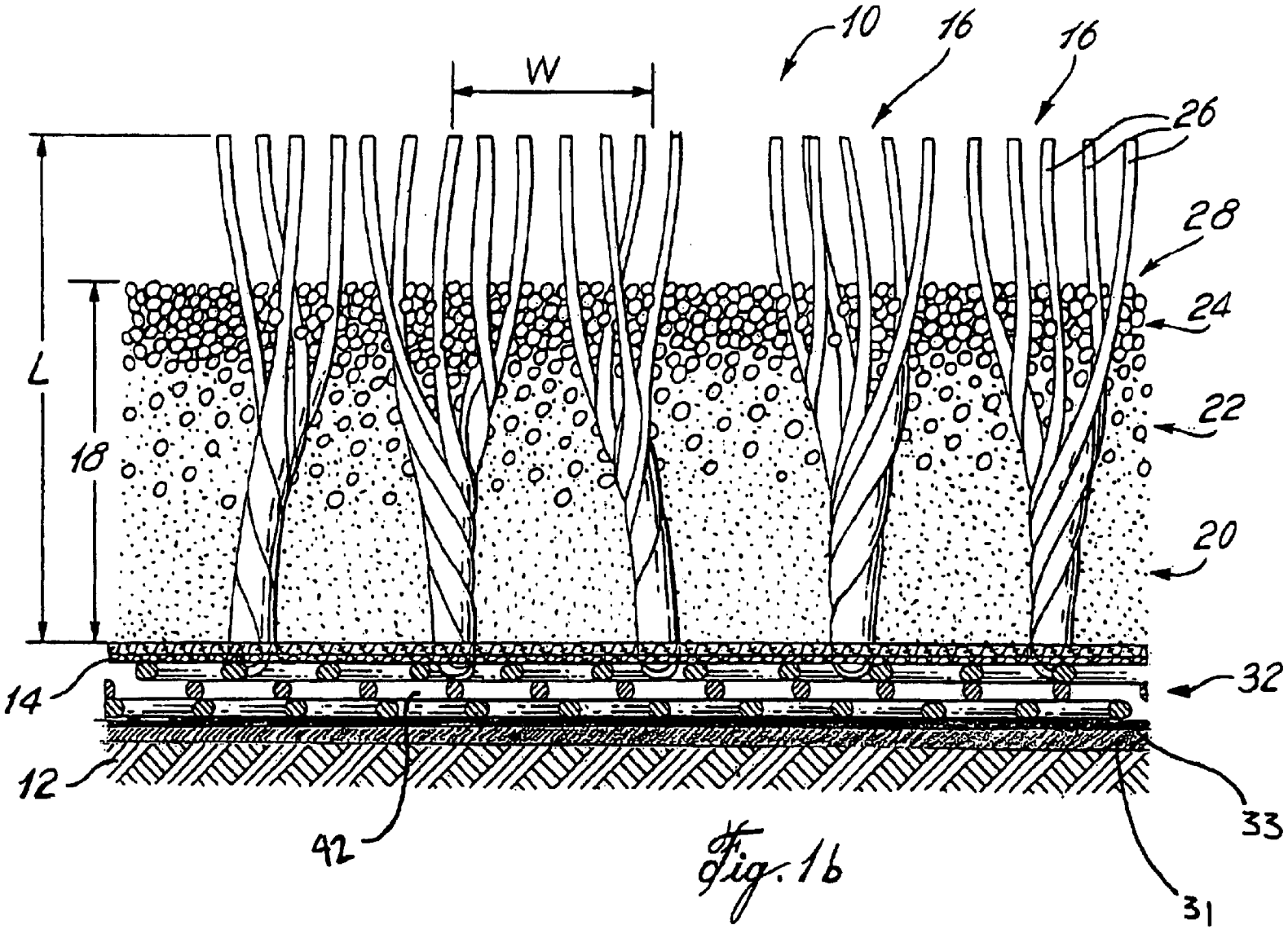
FIG. 1*b* is a cross-sectional view of an installed synthetic grass turf assembly with a drainage system according to an alternate embodiment of the invention.

The supporting soil substrate 12 is formed, for example, by removing turf, loam, etc., and grading and compacting the earth. Excavation of materials is necessary to establish a proper grade of the supporting soil substrate 12 to a tolerance of about 1-inch per 10 feet. The supporting soil substrate 12 is compacted to about 95% Proctor density, if possible, to form a firm and stable surface. Then a layer of concrete or asphalt is placed on the compacted earth, in order to ensure the grade and to provide an impervious barrier to the water being drained. Instead of the concrete or asphalt, a layer of non-porous stone may be provided which is compacted to form a stone base 31. This stone base may be relatively inexpensive, as it need not be graded. An impermeable membrane 33 can then be placed on the stone base 31 to complete the water barrier, as seen in FIG. 1*b*. Preferably, the slope of the supporting substrate 12 is 0.5% to about 1%, depending on the IDF rainfall curves for specific areas, from the field center line downwards to opposed edges of the field in order to facilitate drainage.

Situated over the support substrate 12, in one embodiment, is a spacing grid 32, preferably made of extruded triplanar polypropylene or polyethylene material. The spacing grid 32 directly supports the undersurface of the backing 14, and as a result, the backing 14 is spaced apart from the supporting substrate 12.

Figure 2:
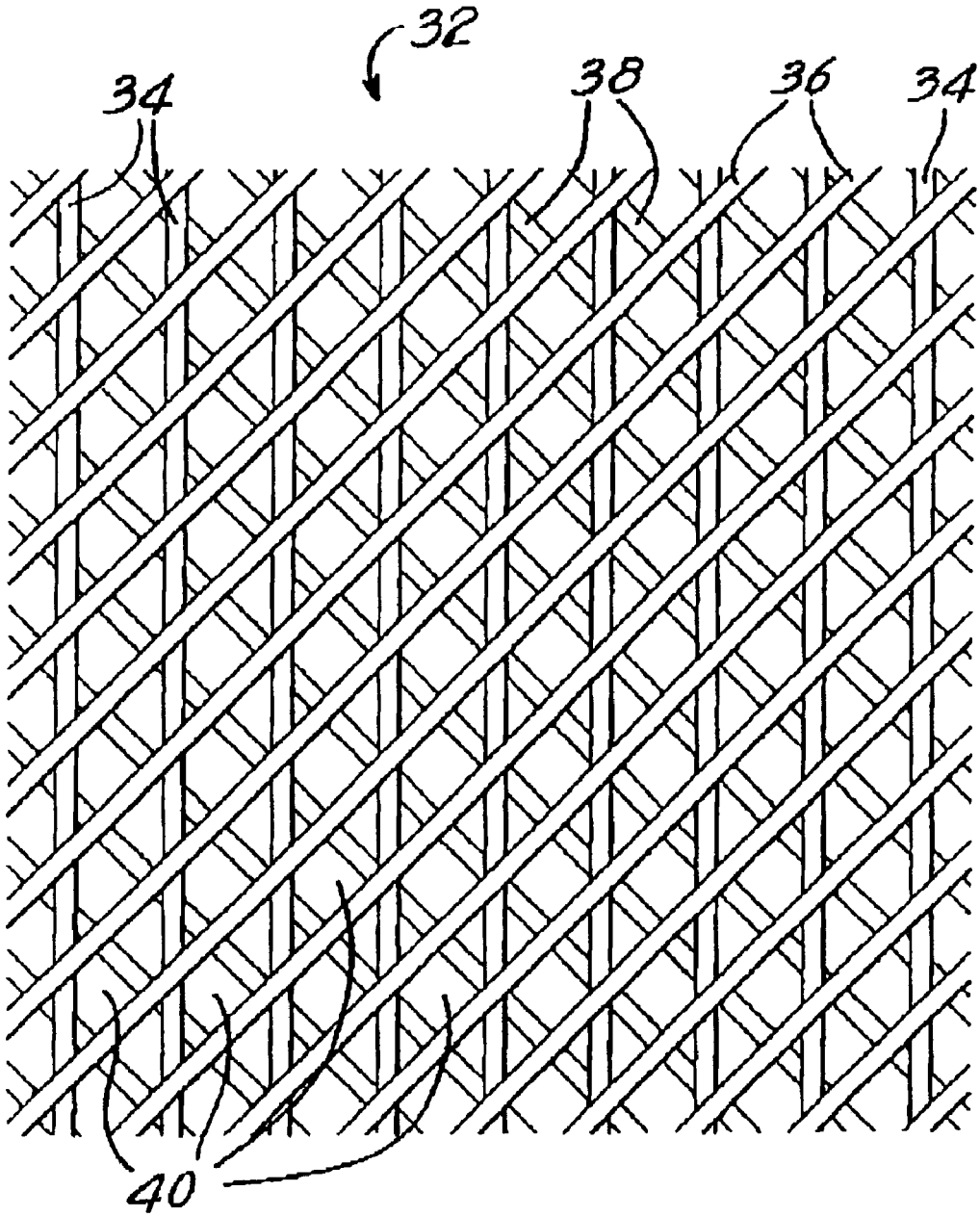
FIG. 2 is a plan view of a spacing grid used in the embodiment shown in FIG. 1.

The spacing grid 32, more clearly shown in FIGS. 1 and 2, includes a plurality of longitudinal grid members 34 which are parallel to each other and form a base layer of the grid, and a plurality of link elements 36 at one side and link members 38 at the other side of the spacing grid 32 which form two respective outer layers of the grid to bond the longitudinal grid members 34 in position. The link elements 36 and 38 are elongated and extend diagonally with respect to the longitudinal grid members 34 according to this embodiment of the invention. The diagonal directions of the respective link elements 36 and 38 at the opposite sides of the spacing grid are angularly crossed, preferably perpendicular to each other, as shown in FIG. 2. The spacing grid has a thickness that can be from ⅕ inch (5.08 mm) to 1½ inch (38.1 mm) in accordance with this embodiment to provide an adequate draining space between the backing 14 and the porous aggregate layer 30. The thickness of the spacing device is inversely proportional to the degree of slope of the field.

The spacing grid 32 with such a structure provides a plurality of draining apertures 40 defined by the longitudinal grid members 34 and the diagonal link elements 36 and 38 to permit water drained vertically from the grass turf through the spacing grid 32 in which water is drained toward the field edges.

The spacing grid 32 provides substantially horizontal draining passages defined between adjacent longitudinal grid members 34, as indicated by numeral 42 in FIG. 1, which permits water to flow freely along the passage 42, horizontally through the spacing grid 32 when water is accumulated in the porous aggregate layer 30 and is enabled to be drained promptly through the layer 30. For this purpose, the thickness of the base layer formed by the grid members 34 should be much greater than the thickness of the outer layers formed by the link elements 36 and 38. The spacing grid 32 is preferably positioned in a direction such that the longitudinal grid members extend from the field center line to the opposed edges, aligning with the slope direction of the supporting soil substrate to achieve the best drainage result.

The spacing grid 32 is preferably manufactured in a light colour such as white because a dark coloured plastic spacing grid, installed outdoors, absorbs more heat energy which results in deformation thereof.

In high rainfall areas, a geotextile, that is, a non-woven porous membrane made of needle-punch poly-propylene, may be placed immediately over the spacing grid 32. In fact, the geotextile membrane could be attached directly to the spacing grid 32 at the manufacturing plant. The membrane could also be woven.

The geotextile membrane prevents sand or other infill material from entering the interstices formed in the grid 32 which would tend to block the passages so formed in the grid 32. This, however, would reduce the function between the grass surface and the geogrid and could cause movement of the grass surface which may result in line deformation unless the backing material has a non-slip characteristic that does not allow the grass to slide on it.

In a preferred embodiment, the backing 14 is made in accordance with Canadian patent application 2,218,314 and U.S. Pat. No. 5,958,927, herewith incorporated by reference. This backing prevents the infill from passing through the backing into the spacing grid 32, thereby preventing blocking of the drainage passages.

Figure 3:
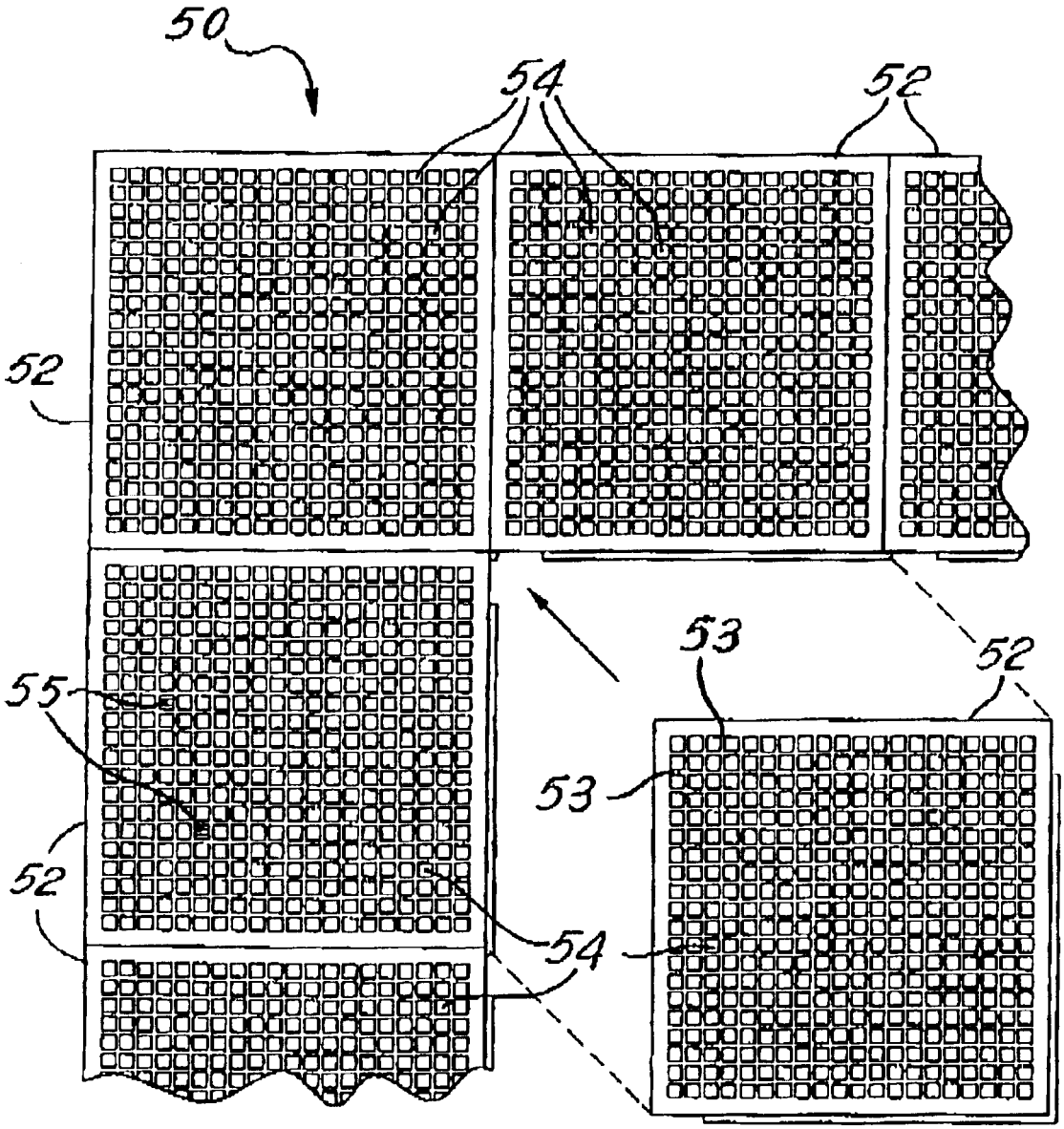
FIG. 3 is a plan view of a layer of drainage tiles.

Another preferred embodiment is illustrated in FIG. 3. In this embodiment, the drainage device is in the form of interconnecting tiles 50 made up of individual tiles 52. The tiles 52 are generally square but could be made up of various shapes. The tiles 52 include intersecting grooves or channels 53 defining square lugs 54. The opposite surface of the tile 52 would have similar channels 53 and lugs 54. Through openings 55 extend from one surface to the other and provide drainage passages for the vertical flow of the water, and communicate with the channels 53 in order to evacuate the water horizontally. The interconnected tiles would normally sit on the support substrate 12 and would be in direct contact with the backing 14 in order to allow the water to pass through the backing 14 and then along the channels 53, on the top of the tiles 52, or through the openings 55 to access the channels 53 on the bottom of tiles 50.

Figure 4:
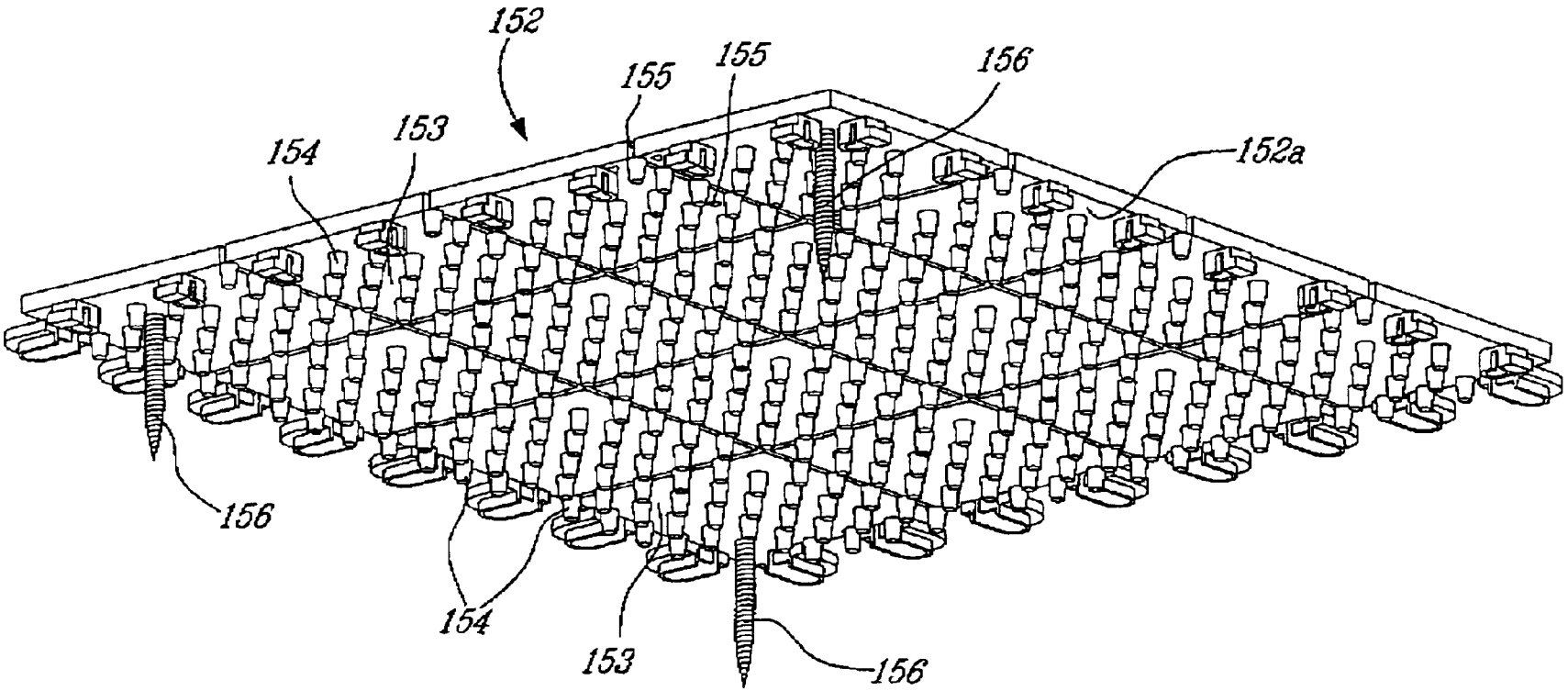
FIG. 4 is a perspective view taken from the bottom of another embodiment of a drainage tile.

FIG. 4 shows another embodiment of the tile 152, in accordance with the present invention, having a bottom surface 152*a* and a plurality of lugs 154 extending from the bottom surface 152*a*. The lugs 154 define channels 153 to provide the necessary drainage from edge to edge. Through openings 155 are provided to allow drainage perpendicular to the tile 152. Nails 156 are provided for anchoring the tiles to the support substrate 12.

Figure 5:
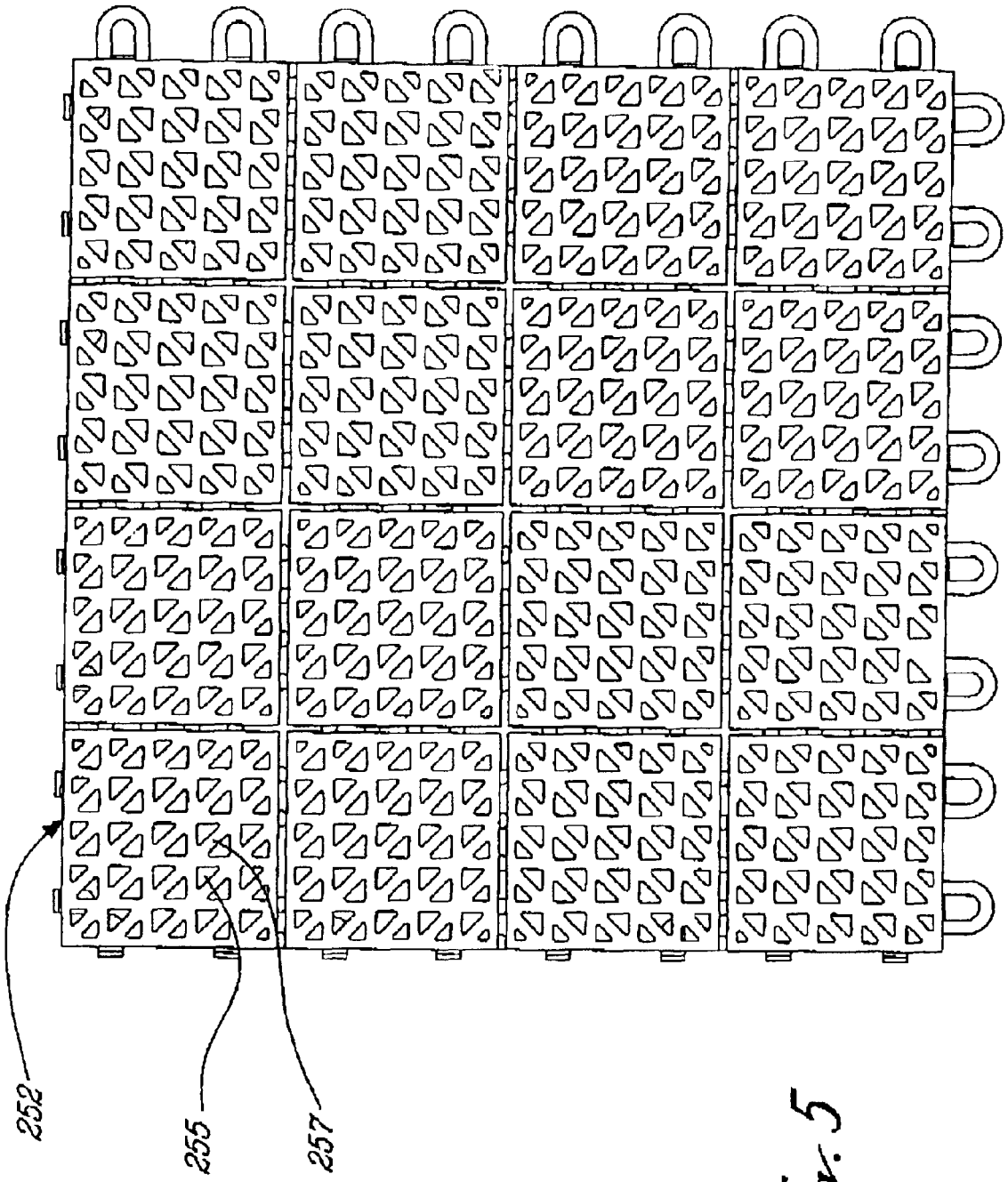
FIG. 5 is a perspective view taken from the top of still another embodiment of a drainage tile.
Figure 6:
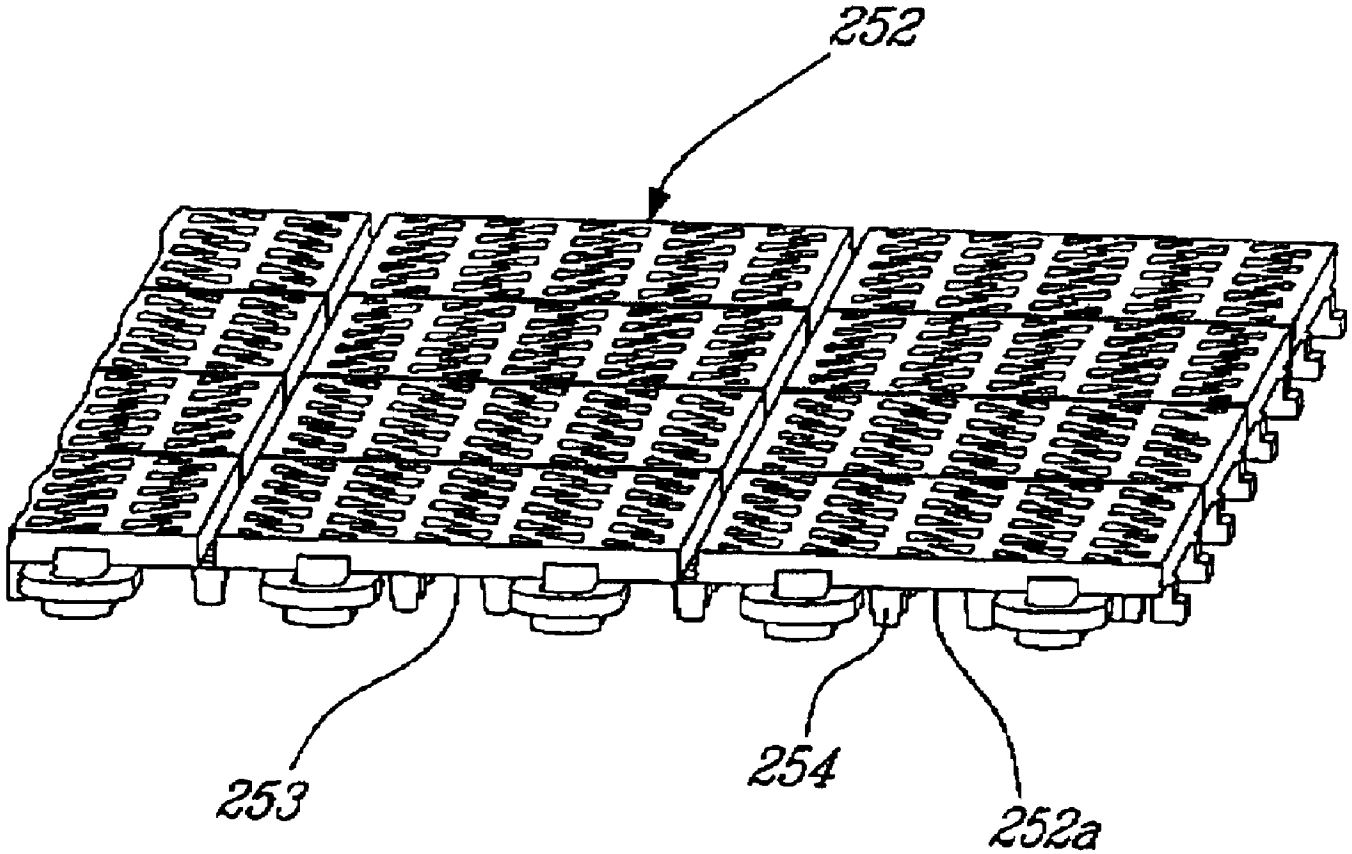
FIG. 6 is a perspective view, taken from the side, of the embodiment shown in FIG. 5.

In yet another embodiment, the tiles 252 shown in FIGS. 5 and 6 show the through openings 255 as a pattern of openings defined by links 257. Lugs 254 are provided on the bottom surface 252*a* to define the channels 253.

Although the above description and accompanying drawings relate to a specific preferred embodiment as presently contemplated by the inventor, it will be understood that the invention in its broad aspect includes mechanical and functional equivalents of the elements described and illustrated. Modifications and improvements to the above-described embodiment of the invention may become apparent to those skilled in the art. The foregoing description is intended to be exemplary rather than limiting. The scope of the invention is intended to be limited solely by the scope of the appended claims.

I claim:

1. A synthetic grass turf drainage system for installation on a supporting soil substrate to provide an easily drained synthetic grass turf surface, the drainage system comprising:

a synthetic grass turf assembly having a flexible and water permeable sheet backing from which a plurality of upstanding synthetic ribbons extend, the sheet backing defining an upper surface and an under surface, an infill layer of particulate material being disposed interstitially between the upstanding ribbons on the upper surface of the sheet backing;

an impermeable membrane disposed on top of the soil substrate; and a structurally self-supporting three-dimensional spacing device having a top and a bottom surface defining a spacing distance therebetween, said spacing device being disposed between the impermeable membrane and the synthetic grass turf assembly such that bottom surface thereof abuts the impermeable membrane and the top surface thereof abuts the under surface of the sheet backing, the spacing device thereby elevating the sheet backing away from the impermeable membrane on the soil substrate by said spacing distance, the spacing device having draining passages in both vertical and substantially horizontal directions throughout said spacing distance such that drainage in both vertical and substantially horizontal directions is possible at any elevation between said sheet backing and said impermeable membrane.

2. A drainage system for a synthetic grass turf assembly as defined in claim 1, wherein the spacing device comprises a flexible three-dimensional spacing grid.

3. A drainage system as claimed in claim 2, wherein the grid comprises a plurality of longitudinal grid members to form the substantially horizontal drainage passages therebetween when the grid is positioned between the backing and the supporting soil substrate.

4. A drainage system as claimed in claim 3, wherein the spacing grid comprises a plurality of link elements to bond the grid members in position to form the grid without blocking either the vertical draining passages or the substantially horizontal draining passages.

5. A drainage system as claimed in claim 4, wherein the grid members form a base layer and the link elements form two outer layers associated with two opposite sides respectively.

6. A drainage system as claimed in claim 5, wherein the spacing grid is made from a firm yet resilient plastic.

7. A drainage system as claimed in claim 6, wherein the grid is positioned so that the elongated grid members extend in a direction from the field centerline to either one of the opposed edges.

8. A drainage system as claimed in claim 1, wherein the supporting soil substrate and the spacing device are sloped downwards from a field centerline to two opposed edges of the game playing surface to facilitate drainage.

9. A drainage system as defined in claim 1, wherein the supporting soil substrate and the spacing device are sloped from one edge of the assembly to the other in order to facilitate drainage.

10. A drainage system as claimed in claim 1, wherein the supporting soil substrate is selected from one of concrete, asphalt and non-permeable stone base such that the supporting soil substrate prevents water from percolating therethrough.

11. The drainage system as defined in claim 1, wherein the spacing device comprises an assembly of interconnecting tiles having a plurality of elongated channels parallel to each other, on at least one surface of the tile as well as through openings extending from one surface of the tile to the other, in a manner such that water is enabled to flow through the tile in a direction perpendicular to a major plane defined by the tile, and also in another direction from one edge of the tile to another edge such that the water to be drained can flow throughout the interconnected tile assembly.

12. The drainage device as defined in claim 11, wherein each tile includes interconnecting channels on at least one surface such that the water to be drained can flow from one edge to the other and the through openings communicate with the channels.

13. A method for providing a drainage system for a synthetic grass turf assembly installed on a supporting soil substrate to provide a synthetic grass turf surface, the turf assembly including at least a plurality of upstanding synthetic ribbons of selected length, representing grass blades, extending upwardly from an upper surface of a flexible and water permeable sheet backing, the method comprising the steps of:

a) preparing the supporting soil substrate in a slope;

b) placing an impermeable membrane on top of the supporting soil substrate;

c) placing a structurally self-supporting and flexible three-dimensional spacing device on top of the impermeable membrane, the spacing device having draining passages in both vertical and substantially horizontal directions throughout; and d) laying the turf assembly on top of the spacing device without performing any further preparation to the spacing device, the spacing device defining a spacing distance between the impermeable member and the sheet backing of the turf assembly, the draining passages permitting draining in both vertical and substantially horizontal directions at any elevation within the spacing distance.

14. A method as claimed in claim 13, wherein the spacing device is a grid made of material selected from plastic materials, having a plurality of elongated grid members bonded with link elements in a manner such that water is enabled to flow through the grid in a direction perpendicular to a major plane defined by the grid and also in another direction from one edge of the grid to an opposite edge.

15. A method as claimed in claim 13, further comprising a step of preparing the support substrate by removing the organic top layer of soil and compacting the soil, placing a non-permeable firm layer selected from concrete, asphalt, and a non-porous stone base.

16. A method as claimed in claim 15, wherein the non-porous stone base is selected to which the impermeable membrane is placed directly over the stone base.

17. A synthetic grass turf assembly for installation on a supporting soil substrate to provide a synthetic grass turf surface, the turf assembly comprising:

a) a pile fabric with a flexible and water permeable sheet backing and a plurality of upstanding synthetic ribbons of selected length, representing grass blades, extending upwardly from an upper surface of the backing;

b) an infill layer of particulate material disposed interstitially between the upstanding ribbons upon the upper surface of the backing and of a depth less than the length of the ribbons, the particulate material comprising at least one of hard and resilient granules, the infill including:

i) a base course substantially exclusively of hard and resilient granules disposed upon the upper surface of the backing;

ii) a top course substantially exclusively of resilient granules disposed upon the base course extending upwardly; and c) an impermeable membrane disposed on top of the supporting soil substrate;

d) a flexible, structurally self-supporting three-dimensional spacing device elevating an undersurface of the backing away from the impermeable membrane and being disposed therebetween such that a spacing distance between the impermeable membrane and the undersurface is defined, the spacing device having draining passages in both vertical and substantially horizontal directions throughout the spacing distance such that water drainage both vertically and substantially horizontally is possible through the spacing device at any elevation between the backing and the impermeable membrane.

* * * * *